United States Patent [19]

Meeker et al.

[11] 4,368,836

[45] Jan. 18, 1983

[54] SHEET FEEDING APPARATUS

[75] Inventors: James A. Meeker; Christopher J. Jackson; Rick D. Watson, all of Toledo, Ohio

[73] Assignee: Libbey-Owens-Ford Company, Toledo, Ohio

[21] Appl. No.: 198,845

[22] Filed: Oct. 20, 1980

[51] Int. Cl.[3] ..... B65H 17/34

[52] U.S. Cl. ..... 226/172; 425/140

[58] Field of Search ..... 226/170–173, 226/74; 271/34, 35; 425/140

[56] References Cited

U.S. PATENT DOCUMENTS

| | | | |
|---|---|---|---|
| 1,904,885 | 4/1933 | Seeley | 226/172 |
| 2,387,446 | 10/1945 | Herz | 226/172 X |
| 3,341,889 | 9/1967 | Miller et al. | 425/140 |
| 3,341,889 | 9/1967 | Miller et al. . | |

FOREIGN PATENT DOCUMENTS

| | | | |
|---|---|---|---|
| 1083065 | 1/1955 | France | 226/172 |

*Primary Examiner*—Leonard D. Christian

*Attorney, Agent, or Firm*—Collins, Oberlin & Darr

[57] ABSTRACT

Apparatus including a pair of opposed conveyor belts for feeding a plurality of superimposed continuous sheets of refrigerated, thermoplastic material. The active runs of the conveyor belts are guided over platens movable toward and away from each other in a direction normal to the path of movement of the sheet material to generate the necessary tractive forces required to advance the sheet material between the conveyor belts. The platens distribute the tractive forces uniformly over a large sheet contacting area of the belts to prevent cracking and rupturing of the sheet material. Means are provided for compressing the spaced-apart clamping assemblies of a frame assembly to which the sheets are attached for further processing.

8 Claims, 11 Drawing Figures

SHEET FEEDING APPARATUS

BACKGROUND OF THE INVENTION

The present invention relates generally to the production of glare-reducing windows and the like and, more particularly, to an improved apparatus for feeding refrigerated plastic sheet material onto sheet supporting frames employed to shape the sheet material for use as plastic interlayers in bent, laminated safety glass windshields.

Glare-reducing laminated windshields employed in present-day automobiles generally utilize a plastic interlayer having a colored or neutral shaded band extending across the upper marginal edge portion thereof. This band is preferably graduated with the greatest concentration of light-absorbing dye being present nearest the periphery of the plastic interlayer and the concentration thereof diminishing gradually downwardly towards the other edge of the band until finally becoming almost imperceptible at the fade-off line. It has been found that this band greatly reduces discomfort to the driver and other occupants of the vehicle which normally results from direct sun glare through the windshield.

Since the windshield in present automobile designs is mounted in a tilted or non-vertical attitude and because of the longitudinal curvature of the windshield, the otherwise flat plastic interlayer having a rectilinear colored band must be shaped or warped prior to lamination to obtain a fade-off line which is horizontal and substantially parallel to the horizon when the finished curved windshield is installed in its functional inclined position in the automobile.

In a conventional plastic interlayer shaping operation, a plurality of continuous lengths of suitable thermoplastic material are withdrawn from separate supply rolls and fed by a pair of opposed, traction rollers onto an assembly table. The superimposed sheets are then clamped at their free ends in a frame and uniformly stretched or placed in tension by clamping the opposed rollers against the superimposed sheets and bodily moving such rollers in a direction opposite to the direction of sheet advancement. While maintained in this stretched condition, the continuous lengths of plastic also are clamped in the frame along a line remote from the free ends thereof and then cut transversely from the continuous lengths outwardly of the frame to provide a plurality of individual sheets. Thus, the sheets are clamped in a stretched condition in the frame along the two opposite transverse edges only. A succession of these frames, each with a plurality of uniformly taut or tensioned sheets clamped therein, are supported in a vertical orientation and moved in spaced relation first through a heating zone and then through a cooling zone. During heating, the sheets become pliable and the central portions, as well as the unsupported longitudinal edges thereof, sag downwardly by gravity in the plane of the sheets to the desired curvatures or shapes. Sometimes, external tractive forces are applied to the lower, unsupported edges of the sheets to assist in distorting or warping the sheets to the desired curvatures. While maintained in such distorted or warped condition, the sheets are cooled to set the same in these desired shapes.

While the traction rollers utilized to feed the sheet material in the above described process admirably serve the purpose for which they are intended, they do possess certain disadvantages. For example, the tractive forces are concentrated along a narrow line of contact between the rollers and the sheet material, tending to crimp or distort the sheet material. This is especially so upon clamping the sheet material therebetween during the sheet stretching operation. Such deformed portions must be cut from the continuous stock and discarded, resulting in wastage of the expensive thermoplastic material.

Another problem in using the conventional thermoplastic materials in their natural state is that a parting agent, in the form of a fine powdery substance, is employed between adjacent convolutions of the supply rolls to prevent adhesion therebetween and to facilitate the dispensing and handling thereof. However, the parting agent not only creates a dusty and polluted environment but, more importantly, requires costly removal as by washing prior to the final assembly of the plastic sheets with the glass panels. Consequently, refrigerated thermoplastic material has been developed to obviate the need for a parting material and the shortcomings associated therewith. However, due to the rigidity of such refrigerated plastic material, the pressure of the opposed rollers applied against the sheets to feed the same tend to crack, rupture and/or somewhat distort the sheet material, thereby destroying its utility as interlayers in the laminated glass, and particularly in windshields, where optical requirements must be maintained within close tolerances.

SUMMARY OF THE INVENTION

Accordingly, the primary object of the present invention is to provide a new and improved apparatus for efficiently feeding thermoplastic sheet material, and especially refrigerated thermoplastic sheet material, without adversely affecting the same.

Another object of this invention is to provide in the foregoing feeding apparatus novel means having large sheet contacting surfaces to distribute the tractive forces uniformly over a substantial area.

A further object of the present invention is to provide in conjunction with the feeding apparatus an assembly table for locating the special frame adapted to support several individual refrigerated thermoplastic sheets for subsequent shaping operations.

Still a further object of this invention is to provide the foregoing assembly table with means for locating and compressing the spaced apart clamping assemblies of the special frame employed to support the individual refrigerated thermoplastic sheets.

The foregoing and other objects, advantages and characterizing features of the present invention will become clearly apparent from the ensuing detailed description thereof, considered in conjunction with the accompanying drawings, wherein like reference numerals denote like parts throughout the various views.

BRIEF DESCRIPTION OF THE DRAWINGS

FIG. 3 is an enlarged, fragmentary side elevational view of the feed head of this invention;

DESCRIPTION OF THE PREFERRED EMBODIMENT

Figures 1, 2:
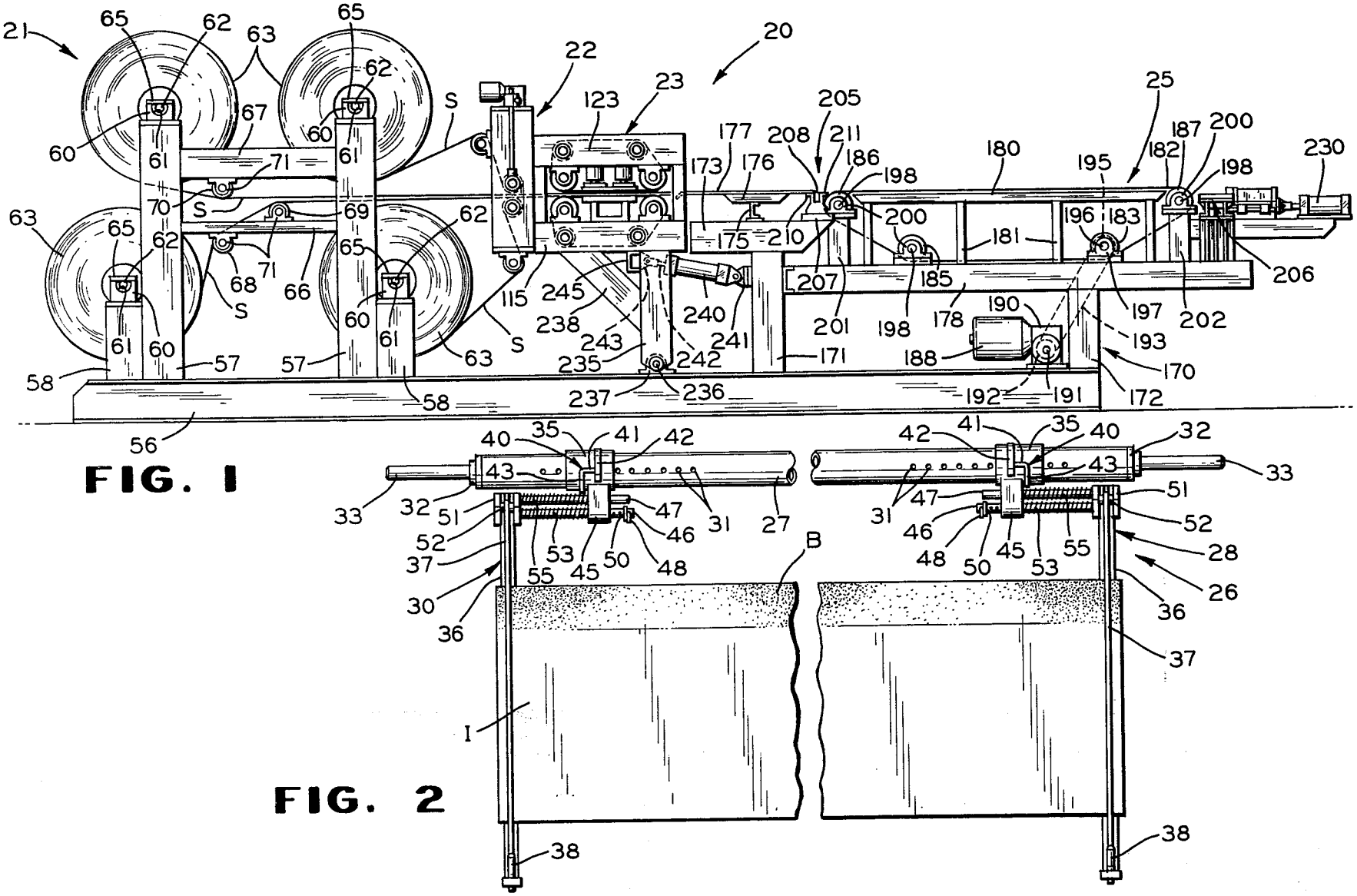
FIG. 1 is a side elevational view of a sheet material feeding apparatus constructed in accordance with this invention.
FIG. 2 is a front elevational view of a sheet-supporting frame assembly adapted to facilitate shaping of the individual plastic sheets attached thereto.

Referring now in detail to the illustrative embodiment depicted in the accompanying drawings, there is shown in FIG. 1 a sheet material feeding apparatus, comprehensively designated 20, which embodies the novel features of this invention and is adapted to feed a plurality of sheets of continuous lengths onto an assembly table for securement to a frame assembly in preparation for a plastic sheet shaping operation. Generally, the apparatus 20 includes a roll supply unit 21, a guide unit 22, a feed head 23 and an assembly table 25 for supporting a frame assembly 26 (FIG. 2) to which the sheet material, when cut to length, is attached for further processing. While the material being handled preferably is refrigerated thermoplastic sheet material, it should be appreciated that the feeding apparatus of this invention is not limited thereto, but has utility in processing any plastic material or suitable nonplastic sheet material, as desired.

The particular sheets adapted to be ultimately supported by the frame assembly 26 are utilized as interlayers I adapted to be interposed between and bonded to two sheets of curved glass to form a compound, laminated, glare-reducing glazing closure, such as an automobile windshield, for example. These interlayers are formed of a suitable thermoplastic material, such as polyvinyl butyral resin for example, and are provided with a glare-reducing area or band B extending along and parallel to the upper longitudinal edge of the sheet. The band B may be of a colored or neutral shade, as desired, and graduated in intensity from a relatively dark hue adjacent the upper marginal edge of the sheet to practical extinction at the inner or lower edge of the band, so as to terminate in an almost imperceptible fade-off line. As is known, the purpose of the band B is to provide within the finished laminated glazing closure an area effective to reduce, if not eliminate, objectionable glare directly from the sun or indirectly via reflection from the vehicle's hood and the road surface.

Because the windshield in present automotive designs is mounted in a tilted or inclined attitude and because of the longitudinal curvature thereof about the transverse axis of the windshield, it is necessary to distort or warp an interlayer having a glare-reducing hand into a generally arcuate shape in order to obtain a glare-reducing band which is horizontal and substantially parallel to the horizon when the windshield is installed in its inclined functional position of the automobile.

Warping is effected by supporting one or more of these interlayers in a vertical plane along only their opposite vertical edges in the frame assembly 26 while being advanced through a warping furnace where the sheets become pliable and the unsupported edges of the sheets sag downwardly by gravity in the plane of the sheets to the desired curvatures. While maintained in this distorted or warped condition, the sheets are cooled to set the same in their desired shapes. As shown in FIG. 2, the frame assembly 26 includes a relatively lightweight, tubular carrier bar 27 and a pair of sheet clamping assemblies 28 and 30 suspended from the carrier bar 27 and adapted to secure the transverse opposite edges of one or more thermoplastic sheets. The carrier bar 27 is provided with a plurality of longitudinally spaced, diametrically aligned paired openings 31 for a purpose hereinafter described. Each end of the carrier bar 27 is closed by a plug 32 having a cylindrical supporting rod 33 rigidly secured thereto and projecting axially outwardly therefrom.

The clamping assemblies 28 and 30 are substantially identical in construction but mirror images of each other, each comprising a collar 35 slidably mounted on the carrier bar 27, clamping arms 36 and 37 indirectly attached to the collar for securing the opposite transverse edge portions of the sheets, and a locking device 38 for securing each set of clamping arms 36 and 37 together.

The collars 35 and assemblies 28 and 30 can be adjustably slid along the carrier bar 27 and then set in such adjusted positions to dispose them in the desired spaced-apart relation corresponding to the particular lengths of the thermoplastic sheets to be shaped. To this end, each collar 35 is provided with a pair of diametrically opposed openings adapted to register with the carrier bar openings 31 when the clamping assemblies 28 and 30 are adjusted to their selectively spaced apart positions. A locking key, generally designated 40, is formed with a pin or shank (not shown) for insertion into the aligned openings of collar 35 and carrier bar 27, respectively, to secure the associated collar 35 in the desired position. The key 40 also is formed with an integral transverse portion 41 adapted to bear against the outer surface of collar 35 and held in place by means of a spring clip 42. The clip 42 can be swung laterally to free the portion 41 for removal or insertion of the pin. The key portion 41 is formed with an angularly related portion 43 which serves as a handle to facilitate easy insertion and removal of the pin into and out of the aligned openings of the collar 35 and carrier bar 27, respectively.

Each collar 35 is provided with a depending lug 45 formed with a pair of vertically spaced bores therethrough for receiving a pair of rods 46 and 47 extending and slideable therethrough. The lower rod 46 is provided adjacent one end thereof with a series of longitudinally spaced, transverse openings for selectively receiving a hitch-pin clip 48 adapted to bear against a washer 50 disposed about rod 46 and which serves as a stop in limiting outward movement of the rod 46. The other ends of the rods 46 and 47 are affixed to one of two opposite side walls of a generally U-shaped lug 51. The clamping arm 36 is rigidly secured at its upper end to the web of lug 51 and is substantially U-shaped in cross-section to define a longitudinally extending channel (not shown) for receiving the associated clamping arm 37. The clamping arm 37 is pivotally mounted on a transverse pivot pin 52 supported in the lug 51. The opposite transverse edges of several rigid, refrigerated, thermoplastic sheets are secured between the channeled, clamping arms 36 and the pivotable arms 37 of the clamping assemblies 28 and 30, respectively. The arms 36 and 37 of each clamping assembly 28,30 are then secured in clamping relation by means of the locking device 38.

The frame assembly 26 is provided with means for effecting a gradual stretching and tensioning of the refrigerated thermoplastic sheets as the stresses therein are relieved during the successive thawing and heating thereof during their passage through the warping oven. Such means include helical springs 53 and 55 disposed about the rods 46 and 47, respectively, in abutting engagement at their respective opposite ends against lugs 45 and the inner sidewall of lug 51. These springs impose a bias force against the clamping assemblies 28 and 30 urging the latter apart as the thermoplastic sheets secured therebetween become heat-softened to stretch and laterally tension the same. The selected positioning of the hitch-pin clips 48 in the openings of rods 46 determines the extent of stretching, in turn dictated by the size of the sheet and the degree of curvature required in the glare-reducing band for use with the specific bent glass sheets with which the shaped plastic sheets are subsequently assembled. For a more detailed description of the frame assembly of this type, reference may be had to copending application Ser. No. 135,212, filed Mar. 28, 1980 and assigned to the same assignee as the present invention.

As shown in FIG. 1, the roll supply unit 21 is suitably mounted on a base frame 56 and comprises a longitudinally spaced pair of long, upright support posts 57 and a pair of longitudinally spaced short upright support posts 58 on each side of the unit 21 with the posts on opposite sides of the unit being laterally aligned. Each of the support posts 57,58 is provided with a trunnion block 60 having an arcuate groove 61 for receiving the laterally extending shaft 62 projecting from each side of a supply roll 63 of the refrigerated, thermoplastic sheet material S. A hold down bar 65 is utilized to secure each of the shafts 62 in place. Thus, the roll supply unit 21 supports four supply rolls 63, it being understood that the unit 21 can be modified to accommodate more or less than four rolls, as desired.

The roll supply unit 21 is equipped with horizontal bars 66 and 67 for supporting a series of idler rolls 68, 69 and 70, each being provided with shafts suitably journalled at their opposite ends in bearing brackets 71 mounted on the bars 66 and 67, respectively. The sheet material from the lower, outer supply roll 63 is trained upwardly over idler rolls 68 and 69 and then horizontally toward the guide unit 22. The sheet material from the upper, outer supply roll 63 is trained downwardly about idler roll 70 and then horizontally toward the guide unit 22.

Figure 4:
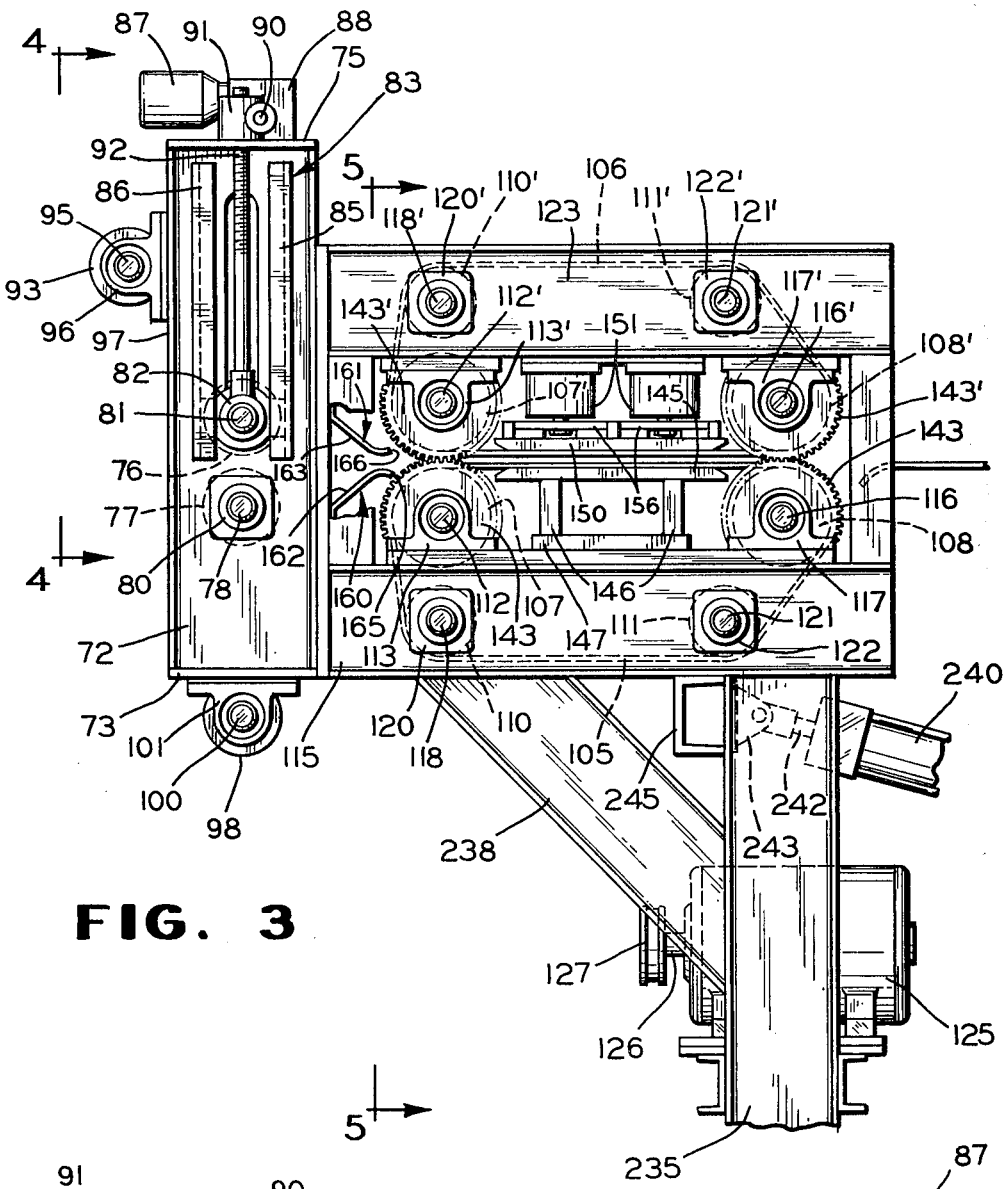
FIG. 4 is a front elevational view, looking in the direction of arrows 4—4 of FIG. 3.

As best shown in FIGS. 3 and 4, the guide unit 22 is fixedly mounted to the feed head 23 adjacent the entry end thereof. The unit 22 is comprised of a substantially rectangular, upright structure having vertically extending side walls 72 supported on a base plate 73 and surmounted by a top plate 75. A pair of guide rolls 76 and 77 are rotatably mounted between the sidewalls 72 with roll 77 mounted on a shaft 78 suitably journalled at its opposite ends in bearing blocks 80 rigidly secured to the sidewalls 72.

Roll 76 is mounted for selective vertical movement toward and away from the fixed roll 77. To this end, roll 76 is provided with a shaft 81 journalled for rotation at its opposite ends in bearing blocks 82 adapted to slide vertically within guide tracks 83, each formed by a pair of spaced, opposed angle members 85 and 86 secured to the side wall 72. The means for raising or lowering the roll 76 includes an electric motor 87 mounted on plate 75 and connected to a suitable source of electrical power (not shown). The motor 87 drives, via gear reduction mechanism 88, a drive shaft 90, in turn operatively connected by means of gear boxes 91 to vertically extending screws 92 attached at their distal ends to the bearing blocks 82. Thus, the roll 76 is adjustable toward and away from fixed roll 77 in order to accommodate the accumulative thicknesses of any number of plastic sheets passed therebetween.

An idler support roll 93, mounted upwardly and forwardly of rolls 76 and 77, guides the sheet material S from the upper, inner supply roll 63 downwardly towards the guide rolls 76 and 77. The roll 93 is provided with a shaft 95 journalled for rotation at its opposite ends in bearing blocks 96 affixed to laterally spaced vertical members 97 at the front face of guide unit 22. A second idler support roll 98, located below the roll 77, guides the sheet material from the lower, inner supply roll 63 upwardly toward the guide rolls 76 and 77. This roll 98 is provided with a shaft 100 journalled for rotation at its opposite ends in bearing blocks 101 (only one of which is shown in FIG. 3) rigidly secured to the base plate 73 of guide unit 22.

As earlier noted, in conventional plastic sheet feeding arrangements, a pair of opposed rolls are employed to provide the tractive force required to advance the sheet material therebetween. Since these rolls make only line contact with the sheet material, it can be appreciated that substantial pressures are required to generate the tractive force necessary to overcome frictional resistance of the several continuous plastic sheets in order to withdraw the same from their large supply rolls. These forces acting in a direction perpendicular to the path of movement of the refrigerated thermoplastic material can crack, rupture or distort the rigid sheets, destroying their usefulness as interlayers in automobile windshields and materially increase production costs.

The present invention addresses this problem and provides a solution therefor by providing improved means engageable with the opposite surfaces of the sheet material over large surface areas thereof for advancing the same in a generally horizontal path rapidly and smoothly without any adverse affect thereon. To this end, such means comprise a feed head 23 which includes a pair of vertically spaced, endless conveyor belts 105 and 106 movable in orbital paths and bodily movable vertically toward and away from each other, as will be hereinafter more fully explained.

The lower endless conveyor belt 105 is trained about a pair of drive rolls 107,108 and a pair of idler rolls 110,111. The roll 108 is of the same size and diameter as roll 107 and is located in longitudinally spaced relation therebehind but having its axis disposed in the same horizontal plane as the axis of roll 107. Idler rolls 110 and 111 are of equal sizes and disposed below rolls 107,108 in longitudinally spaced relation with their axes lying in a common horizontal plane.

The drive roll 107 is mounted on a drive shaft 112 having opposite ends suitably journalled for rotation in bearing blocks 113 mounted on the upper flanges of a pair of laterally spaced channel members 115 extending longitudinally along the feed head 23. Drive roll 108 also is mounted on a shaft 116 having opposite ends journalled for rotation in bearing blocks 117 rigidly secured to the upper flanges of channel members 115. Idler roll 110 is mounted on a shaft 118 journalled at its opposite ends in bearing blocks 120 affixed to the webs of channel members 115. Idler roll 111 also is provided with a shaft 121 having opposite ends journalled in bearing blocks 122 secured to the webs of channel members 115.

The upper endless conveyor belt 106 is trained about a pair of rolls designated 107' and 108' and a pair of upper idler rolls 110' and 111'. Since these rolls are similar in construction and operative in the same manner as rolls 107, 108, 110 and 111, they, as well as their shafts and bearing blocks, have been identified by the same reference numerals primed. The bearing blocks 113' and 117' are mounted in an inverted position on the lower flanges of a pair of laterally spaced, upper channel members 123 extending longitudinally along the sides of the feed head 23. Bearing blocks 120' and 122' are rigidly secured to the webs of channel members 123.

Figure 5:
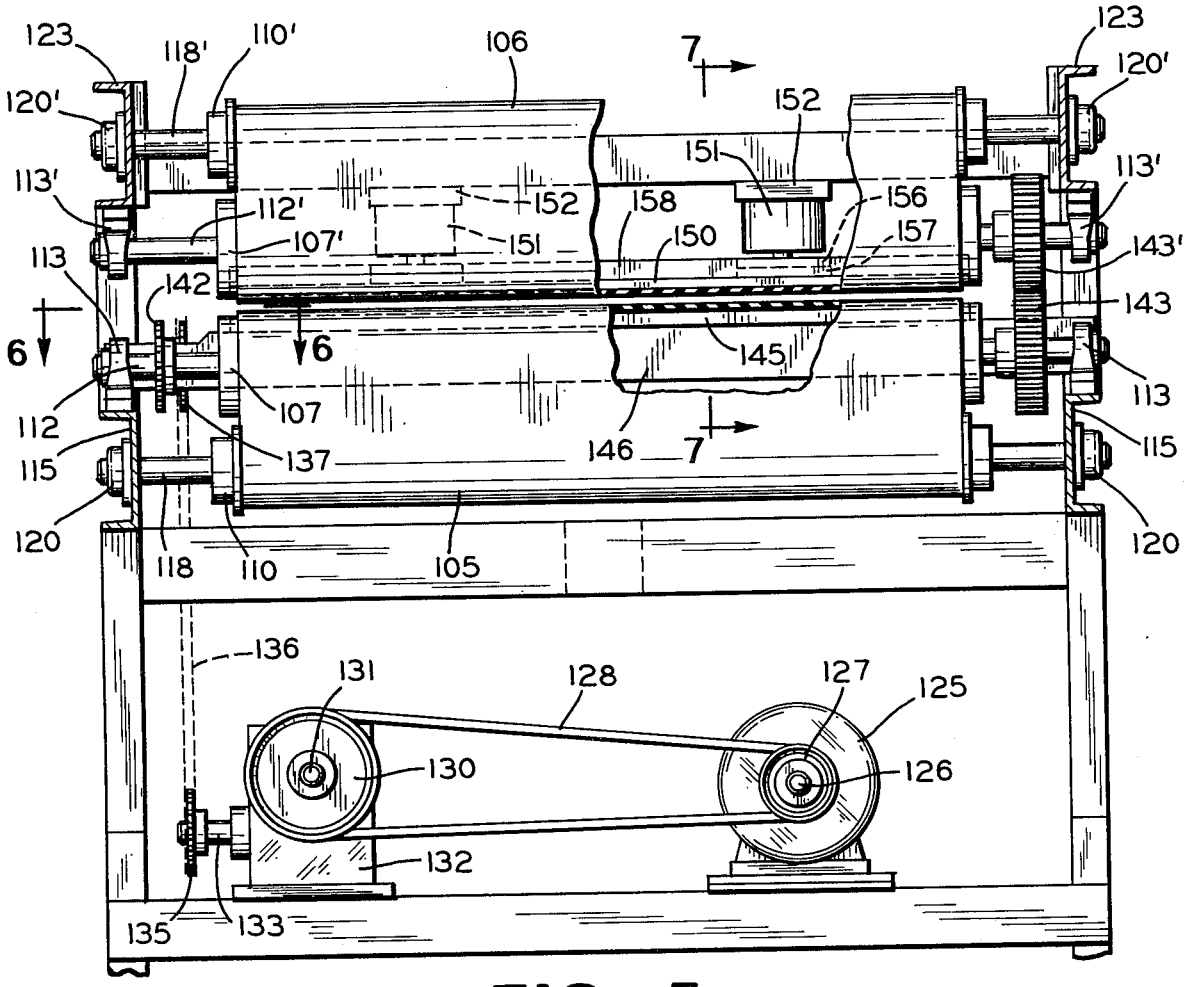
FIG. 5 is a vertical sectional view, taken along the line 5—5 of FIG. 3.
Figure 6:
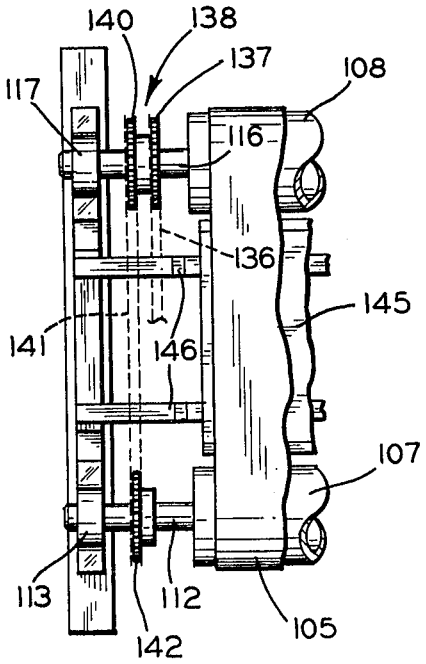
FIG. 6 is a horizontal sectional view, taken along the line 6—6 of FIG. 5.
Figure 7:
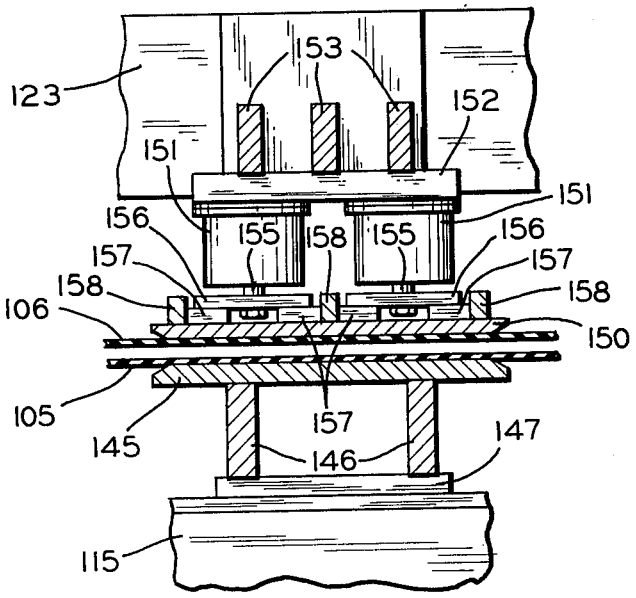
FIG. 7 is a vertical sectional view, on an enlarged scale, taken along the line 7—7 of FIG. 5.

The means for rotating the several rolls and thereby the conveyor belts 105 and 106 includes an electric motor 125 connected to a suitable source of electric power (not shown) and having an output shaft 126 provided with a drive pulley 127 (FIG. 5). A drive belt 128 is trained about the drive pulley 127 and a driven pulley 130 mounted on a shaft 131. The shaft 131, in turn, rotates via gear reduction mechanism 132, a shaft 133 having a drive sprocket 135 secured thereto. A drive chain 136 is trained about the drive sprocket 135 as well as one of the sprockets 137 of a dual sprocket assembly 138 mounted on one end of the shaft 116 of roll 108 (FIG. 6). The other sprocket 140 of assembly 138 is provided with a drive chain 141 also entrained about a sprocket 142 mounted on one end of the shaft 112 of roll 107. Additionally, both shafts 112 and 116 are provided at their other ends with gears 143 enmeshed with gears 143' of the associated shafts 112' and 116' of rolls 107' and 108', respectively. Thus, operation of motor 125, through the drive train described above, effects rotation of the lower and upper sets of rolls 107–111 and 107'–111' to move the belts 105 and 106 in unison through their respective orbital paths.

The active runs of the belts 105,106 are relatively movable bodily toward and away from each other in order to grip the multilayered continuous sheets S therebetween for advancing the same forwardly. In the embodiment therein described and shown in the drawings, the active run of the lower conveyor belt 105 is maintained fixed in its horizontal plane while the active run of the upper conveyor belt 106 is moved vertically toward and away from belt 105. To this end, the active run of conveyor belt 105 is supported on a fixed platen 145 (FIGS. 5 and 6) having a transverse dimension slightly greater than the width of the belt 105 and supported on a pair of upright supports 146 mounted on a base plate 147 affixed to the frame of feed head 23. The active run of conveyor belt 106 is guided over a movable platen 150 having a transverse dimension slightly greater than the width of belt 106. The means for supporting platen 150 includes laterally spaced, paired cylinders 151 suitably secured to rectangular mounting plates 152, in turn affixed to structural members 153 mounted on the frame of feed head 23. Each cylinder 151 is provided with the usual reciprocating piston (not shown) having a piston rod 155 connected to a plate 156 having support bars 157 rigidly secured to the platen 150. A series of laterally spaced, elongated reinforcement members 158 are attached to the upper surface of the platen 150 and extend lengthwise thereof to rigidify and strengthen the same. While preferably four cylinders 151 are employed in the illustrative embodiment of this invention, it should be appreciated that only one or any number of such cylinders can be utilized, as desired, within the purview of this invention.

The large surface areas of the platens 145 and 150 transmit the pressure imposed by the cylinders into tractive forces uniformly distributed over correspondingly large work engaging areas of the opposed belts 105 and 106. Thus, the pressure applied against the opposed surfaces of the refrigerated sheet material is distributed over a large rectangular area thereof, avoiding cracking or rupturing thereof as might otherwise occur by the concentrated, line contact tractive forces applied with the opposed feed rolls of conventional feeding arrangements. Moreover, the fluid pressure acting in the several cylinders 151 can be readily adjusted to impart the requisite tractive force desired as dictated by the specific material being handled.

A pair of shields 160 and 161 are suitably mounted on feed head 23 and are provided with inclined portions 162 and 163 converging toward each other and terminating in horizontal lips 165 and 166 spaced from the several continuous sheets of refrigerated thermoplastic material. These shields 160 and 161 are employed to protect the attendant's hands when threading the sheets from fresh supply rolls into the feeding head.

As shown in FIG. 1, the means for supporting assembly table 25 includes a frame, generally designated 170, comprising long and short vertical columns 171 and 172 along each side of the table 25 and interconnected by suitable, transversely extending cross members. The long columns 171 are surmounted by a block 173 supporting, via structural member 175, a support member 176 having a sheet supporting panel 177 affixed to the upper surface thereof. The short columns 172 support horizontal structural members 178 extending along the sides of the table 25 and connected at their inner ends to the columns 171. The table 25 is provided with a deck 180 mounted on a series of vertical supports 181 secured at their lower opposite ends to the structural members 178.

The deck 180 supports the active run of an endless conveyor belt 182 trained about a drive roll 183 and a plurality of idler rolls 185, 186 and 187. The upper surfaces of the panel 177 and the active run of conveyor belt 182 are in a substantially common horizontal plane to guide the several superimposed continuous sheets in a horizontal path. The means for rotating drive roll 183 includes electric motor 188 for rotating, via gear reduction mechanism 190, an output shaft 191 having a drive sprocket 192. A drive chain 193 is entrained about the drive sprocket 192 and a driven sprocket 195 mounted on the shaft 196 of drive roll 183. The shaft 196 is suitably journalled for rotation at its opposite ends in bearing blocks 197 rigidly secured to the structural members 178.

The idler rolls 185, 186 and 187 are of similar construction with each being mounted on a shaft 198 journalled for rotation at the opposite ends thereof in suitable bearing blocks 200. The bearing blocks 200 of the shaft 198 for the lower roll 185 are mounted on structural members 178 while the bearing blocks 200 of the shafts 198 of the upper rolls 186 and 187 are mounted on pedestals 201 and 202 secured at their lower ends to the structural members 178.

It should be appreciated that prior to advancing the sheet-laden frame assembly 26 through a warping oven, the clamping assemblies 28 and 30 are disposed in a compressed, spaced-apart relation against the bias of springs 53 and 55. The clamping assemblies 28 and 30 are held in such compressed condition by means of the compressive stresses residing in the stiffness of the refrigerated plastic sheets clamped therebetween. As the refrigerated sheets become heat-softened and pliable during their advance through the heated atmosphere of the warping oven, the compressive stresses therein are relieved and overcome by the bias force of the springs acting against the clamping assemblies 28 and 30 to urge them apart and thereby gradually stretch and tension the now softened thermoplastic sheets secured therebetween. Thus, the clamping assemblies 28 and 30 must be initially compressed to the desired extent when attaching the fresh refrigerated theremoplastic sheets thereto. To this end, the assembly table 25 is constructed and equipped to properly locate the frame assembly 26 and to compress the clamping assemblies 28 and 30 thereof to the desired extent in preparation for attaching the refrigerated thermoplastic sheets thereto.

Figure 8:
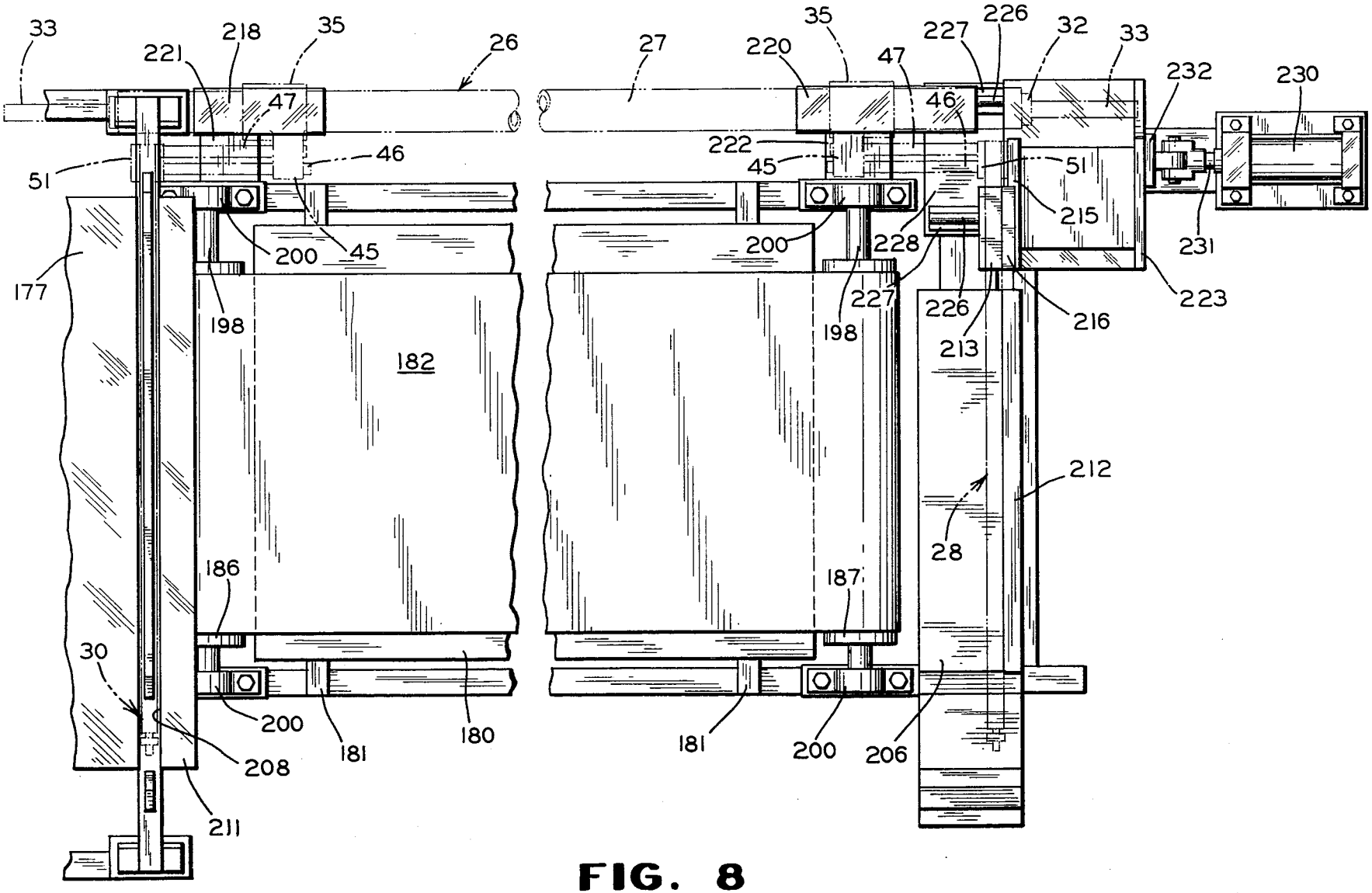
FIG. 8 is a top plan view of the assembly table, showing a sheet-supporting frame assembly supported thereon.

The means for locating and supporting the frame assembly 26 on assembly table 25 includes a locator device, generally designated 205 (FIGS. 1 and 8), interposed between panel 177 and the conveyor belt 182 for locating the clamp assembly 30 of frame assembly 26 while the other clamp assembly 28 is supported on a horizontal support plate 206. The locator device 205 is secured to a mounting plate 207 affixed to the block 173. The locator device 205 extends transversely of table 25 and is formed with an elongated slot 208 extending lengthwise thereof for receiving the clamping assembly 30 of frame assembly 26 shown in phantom in FIG. 8. The slot 208 is defined by spaced upright portions terminating in outwardly extending flanges 210 and 211. The flange 210 is located beneath panel 177 in contact therewith and the flange 211 resides in a common horizontal plane with the active run of conveyor belt 182.

Figure 9:
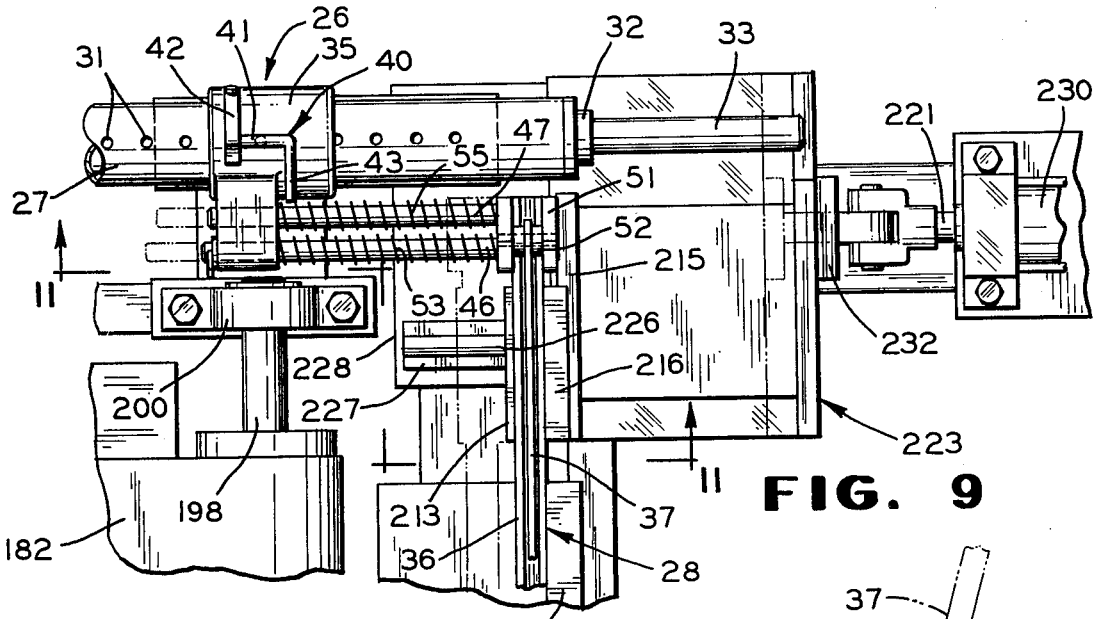
FIG. 9 is an enlarged, fragmentary top plan view of a portion of the assembly table shown in FIG. 8.
Figure 11:
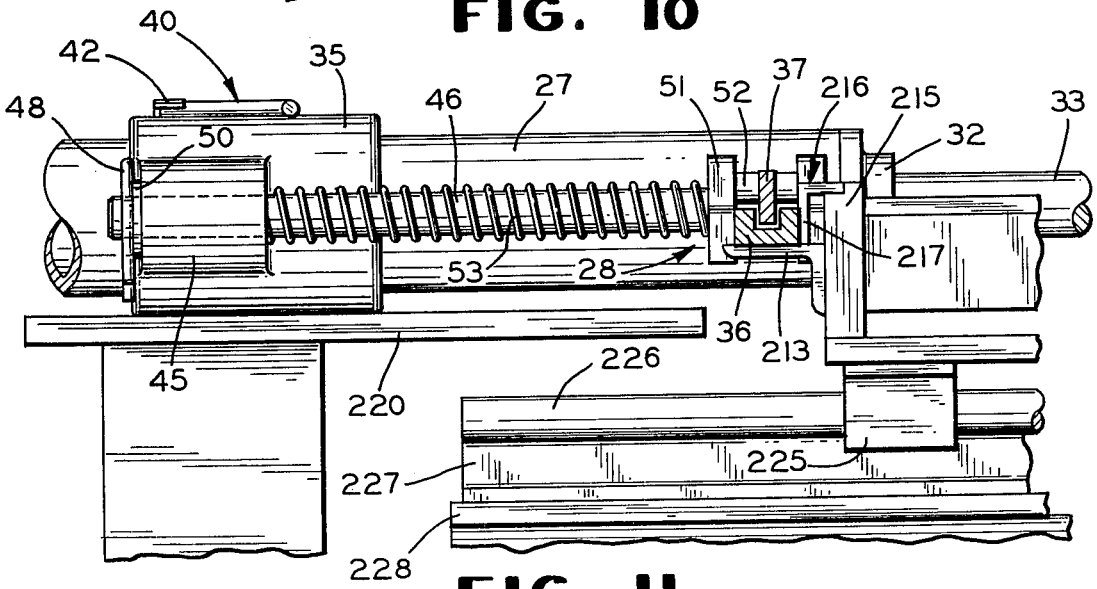
FIG. 11 is a vertical sectional view, on an enlarged scale, taken along line 11—11 of FIG. 9.

The support plate 206 extends transversely of the table 25 and is suitably secured to the frame thereof. Plate 206 is provided with an alignment bar 212 against which the clamp assembly 28 is positioned. The clamp assembly 28 of frame assembly 26 also rests on an arm support 213 spaced from support plate 206 and affixed to a movable pusher plate 215 (FIGS. 9 and 11). The arm support 213 carries an angle member 216, the vertical leg 217 of which abuts against the clamping assembly 28.

The upper end of the frame assembly 26 is supported by resting the two collars 35 on support plates 218 and 220 connected to the assembly table frame by brackets 221 and 222, respectively. Thus, the frame assembly 26 in its natural, uncompressed condition, is placed on the assembly table 25 in the manner shown in phantom in FIG. 8.

Figure 10:
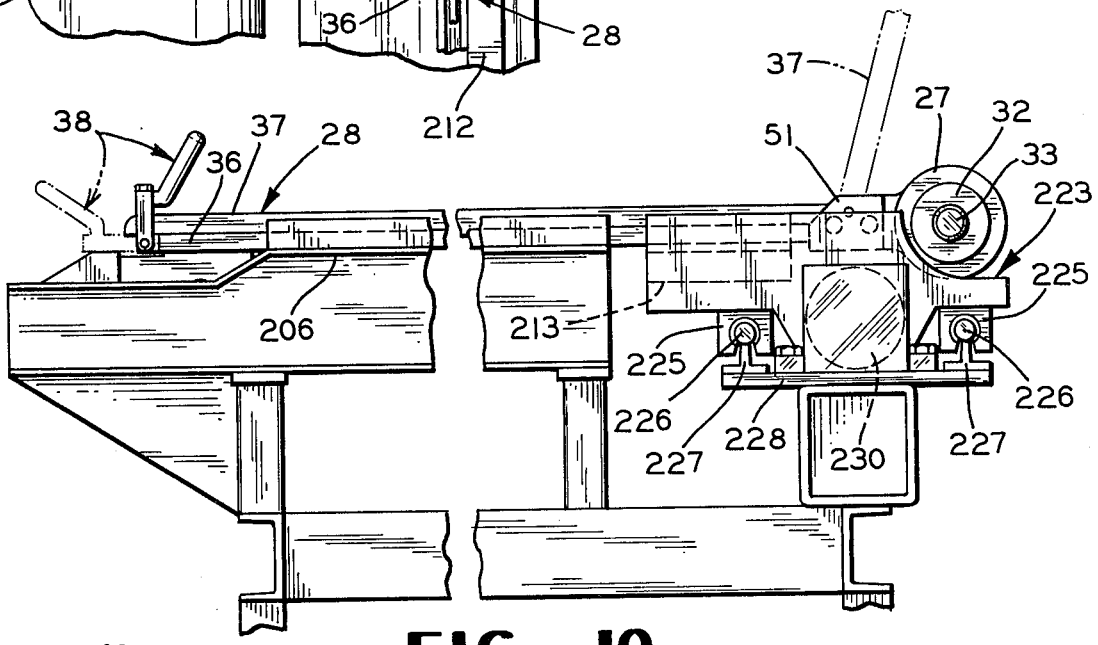
FIG. 10 is an end elevational view of the assembly table shown in FIG. 8.

Means are provided to compress the frame assembly 26 and move the two clamping assemblies 28 and 30 toward each other to the positions required for receiving the refrigerated thermoplastic sheet material. As shown in FIGS. 9–11, such means include the pusher plate 215 which forms a part of a reciprocal block 223 having a pair of bushings 225 adapted to slide on laterally spaced guide rails 226 surmounted on T-shaped structural members 227 carried by a plate 228 mounted on the frame of assembly table 25. The means for moving block 223 includes a fluid cylinder 230 having the usual reciprocal piston (not shown) connected to a piston rod 231 connected to a plate 232 affixed to the block 223. The cylinder 230 is operative to move the block 223 inwardly and, via pusher plate 215 and angle member 216, urge the clamping assembly 28 inwardly against the bias of springs 53 and 55. The sets of springs 53 and 55 associated with both clamping assemblies 28 and 30 are substantially compressed equally as the clamping assembly 28 is moved toward clamping assembly 30 to their desired compressed, spaced-apart positions. Once refrigerated thermoplastic sheets are secured along their opposite transverse edges in the clamping assemblies 28 and 30, the stresses and rigidity of the refrigerated sheets will maintain the clamping assemblies 28 and 30 in this compressed condition against the tension bias of the springs 53 and 55.

The mode of operation of the sheet feeding apparatus 20 of this invention is as follows:

With the several layers of the continuous, refrigerated thermoplastic sheet material S threaded through the feed head 23 between conveyor belts 105 and 106, the frame assembly 26 is placed on the assembly table 25 with the clamping assembly 30 inserted in the slot 208 of locator device 205 and the clamping assembly 28 positioned on support plate 206 against alignment bar 212. The clamping arms 37 are raised relative to their associated arms 36 of the respective clamping assemblies 28 and 30 in readiness for receiving the sheet material. With the movable platen 150 in its lower position under the influence of a low pressure setting in cylinders 151, the conveyor belts 105 and 106 are started to provide the necessary tractive force for withdrawing the several sheets from their respective supply rolls 63 and advance predetermined lengths of the sheets onto the moving conveyor belt 182 until the free ends of the sheets extend over the clamping arm 36 of clamping assembly 28. The conveyor belt 182 facilitates smooth and uninterrupted movement of the sheets on table 25. When the desired lengths of sheet material S has been fed onto table 25, the conveyor belts 105 and 106, as well as the belt 182 are braked to interrupt movement of the sheets on table 25. The superimposed continuous sheets are then secured adjacent their free ends by pivoting the clamping arm 37 of clamping assembly 28 downwardly into clamping relation with arm 36. The arms 36 and 37 are then locked in their clamped relation by manipulating the locking device 38. Thereafter, the continuous lengths of sheet material are also clamped between the arms 36 and 37 of clamping assembly 30. The sheets are then cut transversely from the continuous lengths just outwardly of the clamping assembly 30 to provide a plurality of individual, superimposed sheets secured adjacent their transverse edges to the frame assembly 26 by the clamping assemblies 28 and 30. The frame assembly 26, along with the several sheets supported thereby, is removed from the assembly table 25 in readiness for the plastic shaping operation and the above-described cycle is repeated for securing another series of sheets to a fresh frame assembly 26.

As earlier mentioned, while the sheet feeding apparatus of this invention is especially adapted for processing substantially rigid, refrigerated thermoplastic sheet material, it is not restricted in use to such material, but also has utility in feeding pliable, non-refrigerated plastic material as well as a wide range of nonplastic sheet material. When processing nonrefrigerated thermoplastic sheet material, such as is also employed as interlayers in glazing enclosures for example, it is necessary to stretch or tension the sheet material prior to securely clamping both transverse edges thereof in a frame assembly of the type having clamping assemblies that are maintained in a fixed, spaced-apart relation. In such an arrangement, of course, the pusher block 223 is not utilized.

In order to stretch the material, the feed head 23 is mounted for pivotal movement in a direction opposite the path of advancing movement of the sheet material. To this end, the feed head is supported on and ridigly secured to a pair of laterally spaced, upright structural members 235 (only one of which is shown in FIGS. 1 and 3) mounted at their lower ends for pivotal movement about a common shaft 236 journalled for rotation adjacent its opposite ends in bearing blocks 237 mounted on the base frame 56. A structural member 238 in the form of a brace extends angularly upwardly from the vertical member 235 to the underside of feed head 23.

The means for pivoting feed head 23 includes a fluid cylinder 240 pivotally connected at its head end to a mounting bracket 241 affixed to column 171. The cylinder 240 is provided with the usual reciprocal piston (not shown) connected to a piston rod 242 pivotally connected at its distal end to a mounting plate 243 affixed to a structural cross member 245 forming a part of the feed head frame.

In the production of interlayers formed of non-refrigerated thermoplastic material, the continuous sheets of such material are advanced by the feed head 23 in the same manner described above. After the free ends of the sheets are secured in the proper clamping assembly of the sheet supporting frame assembly, the platen 150 is urged under the influence of high pressure toward the sheet material to clamp the same between the braked conveyor belts 105 and 106. Then the feed head 23 is pivoted rearwardly toward the supply rolls to stretch and uniformly tension the sheet material between the fixed clamping assembly and the feed head. While so stretched or tensioned, the continuous lengths of sheet material are clamped at a point remote from their free ends by the other clamping assembly of the frame assembly and then cut transversely from the continuous lengths outwardly of the frame to provide a plurality of superimposed, individual sheets secured in tension along their opposite transverse edges in the frame assembly.

Actuation of cylinders 151 is effected by conventional fluid control valves properly timed for operation, as are the motors controlling operation of conveyor belts 105,106 and 182, respectively, by suitable electrical timers forming a part of the electric control circuitry. Since such timing arrangements are known and, per se, form no part of the present invention, no further amplification or description thereof is believed necessary. Alternatively, activation of the control valves and motors can be effected by conventional limit switches which are operated when predetermined movements of the movable parts occur.

From the foregoing, it is apparent that the objects of the present invention have been fully accomplished. An improved sheet feeding apparatus is provided, and especially suited, for withdrawing refrigerated thermoplastic sheets from their supply rolls and feeding the same in a desired path of movement without adversely effecting such refrigerated thermoplastic sheets. The tractive force applied by the opposed conveyor belts of the feed head offers substantially large sheet contacting surfaces to distribute the pressure applied against the sheets over a relatively large surface area, precluding any cracking, rupturing or damage to the rigid sheet material as might otherwise occur with conventional sheet fading apparatus. Also, the pressure and thereby the tractive forces acting on the sheet material can be readily adjusted to a fine degree, as required or desired to assure positive feeding without consequent damage to the sheet material. Moreover, the pivotal mounting of the feed head offers versatility in utilizing the apparatus for stretching, as well as feeding, nonrefrigerated plastic sheet materials and eliminates the wastage that is otherwise incurred by known conventional feeding and tensioning apparatus.

It is to be understood that the form of the invention herewith shown and described is to be taken as an illustrative embodiment only of the same, and that various changes in the shape, size and arrangement of parts may be resorted to without departing from the spirit of the invention.

We claim:

1. An apparatus for feeding continuous sheet material in a predetermined path comprising: a frame, means on said frame for guiding sheet material in a generally horizontal plane, a feed head mounted on said frame immediately downstream of said guiding means, said feed head comprising a pair of opposed conveyor belts of substantial widths movable in unison in orbital paths, said conveyor belts having planar, work engaging active runs disposed in an opposed, spaced relation and movable in the same direction, means urging the active run of one of said conveyor belts relative to the active run of the other of said conveyor belts in a direction generally normal to the path of movement of the sheet material to provide a tractive force advancing said sheet material therebetween in said path of movement, said tractive force being distributed uniformly over large sheet engaging surface areas of said belts.

2. An apparatus according to claim 1, including opposed platens having relatively large surfaces engageable against the rear surfaces of the active runs of said conveyor belts.

3. An apparatus according to claim 2, wherein said urging means comprises pressure means applying uniform pressure against the entire surface area of said platen associated with said one conveyor belt to bias said platen thereagainst.

4. An apparatus according to claim 2, wherein each of said platens has a substantial longitudinal dimension and a transverse dimension slightly greater than the width of the associated conveyor belt.

5. An apparatus according to claim 3, wherein said pressure means comprises at least one fluid cylinder applying a predetermined pressure to said platen associated with said one conveyor belt, and means for varying the magnitude of said pressure against said one conveyor belt.

6. An apparatus for feeding continuous sheet material in a predetermined path comprising: a frame, means on said frame for guiding sheet material in a generally horizontal plane, a feed head mounted on said frame immediately downstream of said guiding means, said feed head comprising a pair of opposed conveyor belts movable in unison in orbital paths, said conveyor belts having planar, work engaging active runs disposed in an opposed, spaced relation and movable in the same direction, means urging the active run of one of said conveyor belts relative to the active run of the other of said conveyor belts in a direction generally normal to the path of movement of the sheet material to provide a tractive force advancing said sheet material therebetween in said path of movement, said tractive force being distributed uniformly over large sheet engaging surface areas of said belts, a table adjacent the outlet end of said feed head for supporting a sheet supporting frame assembly having spaced apart clamping assemblies with springs biasing said clamping assemblies apart, said table having means for compressing said clamping assemblies toward each other against the bias of said springs.

7. An apparatus according to claim 6, said table having means at one end thereof for receiving one of said clamping assemblies and a plate adjacent the other end of said table adapted to bear against the other of said clamping assemblies.

8. An apparatus according to claim 7, including means for moving said plate and thereby said other clamping assembly toward said one clamping assembly against the bias of said springs.

* * * * *